US005829232A

United States Patent [19]

Takahashi

[11] Patent Number: 5,829,232

[45] Date of Patent: Nov. 3, 1998

[54] DEVICE FOR DETECTING SHORTAGE OF PRODUCTS IN A PACKAGE

[75] Inventor: Tadashi Takahashi, Chiyoda-ku, Japan

[73] Assignee: Tokyo Automatic Machinery Works, Ltd., Tokyo, Japan

[21] Appl. No.: 881,153

[22] Filed: Jun. 24, 1997

[30] Foreign Application Priority Data

Jun. 28, 1996 [JP] Japan ..... 8-169641

[51] Int. Cl.[6] ..... B65B 19/30

[52] U.S. Cl. ..... 53/499; 53/54; 53/494

[58] Field of Search ..... 53/499, 498, 494, 53/493, 495, 497, 54, 53, 52

[56] References Cited

U.S. PATENT DOCUMENTS 4,856,262 8/1989 Uithoven ..... 53/499

5,097,653 3/1992 Soloman ..... 53/499

5,623,816 4/1997 Edwards et al. ..... 53/499 X

FOREIGN PATENT DOCUMENTS

A-8133223 5/1996 Japan .

*Primary Examiner*—James F. Coan

*Attorney, Agent, or Firm*—Birch, Stewart, Kolasch & Birch, LLP

[57] ABSTRACT

A device for detecting shortage of cigarette packs in a carton has a pair of first proximity sensors capable of individually detecting the cigarette packs at the opposite ends of the carton in an inspecting position, among other cigarette packs in the carton, and a plurality of second proximity sensors capable of individually detecting the remaining cigarette packs in the carton in the inspecting position, the interval between each two adjacent second proximity sensors being longer than the width of each cigarette pack.

9 Claims, 8 Drawing Sheets

DEVICE FOR DETECTING SHORTAGE OF PRODUCTS IN A PACKAGE

BACKGROUND OF THE INVENTION

1. Field of the Invention

The present invention relates to a device for detecting shortage in number of, for example, cigarette packs in a carton or parcel during a process of packaging the cigarette packs in the carton or parcel.

2. Description of the Related Art

A detecting device of this type is described in Jpn. Pat. Appln. KOKAI Publication No. 8-133223, for example. This conventional detecting device is applied to cartons of cigarette packs. In each carton, two rows of cigarette packs are stacked in layers, each pack row including five packs.

The detecting device is provided with five proximity sensors for detecting the cigarette packs in each carton. These sensors are located outside a path of transportation for the cartons. More specifically, two first proximity sensors, among these five sensors, are arranged individually on the opposite end sides of a carton transported on the transportation path, and the remaining three or second proximity sensors beside one side face of the carton.

When one of the pack rows in the carton reaches the location of the proximity sensors, the paired first proximity sensors detect the cigarette packs that are situated at the opposite ends of the first pack row, individually, while the second proximity sensors individually detect the remaining three cigarette packs in the pack row. When the other pack row in the carton reaches the location of the sensors, thereafter, the first and second proximity sensors detect the cigarette packs in the second pack row, individually. More specifically, the proximity sensors detect aluminum foils in the cigarette packs.

In the case of the detecting device described above, each second proximity sensor is located so as to detect the center position of its corresponding cigarette pack in each pack row. Thus, if the width of each cigarette pack is W, the second proximity sensor on each side detects its corresponding pack in a position at a distance of 3W/2 from each corresponding end face of the carton, while the central second proximity sensor detects its corresponding pack in a position at the distance W from the second sensor on each side.

According to this arrangement of the second proximity sensors, the three second sensors may possibly detect the cigarette packs even in case the subject pack row is one cigarette pack short. If the cigarette packs are insufficient in number, the cigarette packs in the pack row sometimes may move from their regular positions. Accordingly, one cigarette pack will inevitably be detected by each of two adjacent second proximity sensors. In this case, the number of cigarette packs in the carton, that is, shortage of the cigarette packs, cannot be detected with accuracy.

SUMMARY OF THE INVENTION

The present invention has been contrived in consideration of these circumstances and its object is to provide a detecting device capable of securely detecting shortage, if any, of articles in number.

The above object is achieved by a detecting device according to the present invention, which comprises a pair of first sensors and a plurality of second sensors. The first sensors are arranged on either side of a transportation path for article rows, and can detect articles situated at the opposite ends of each article row as the article row passes an inspecting position on the transportation path. More specifically, the article rows are arranged at right angles with transportation path, the pair of first sensors individually detect the articles at the opposite ends of the article row and output detection signals only when the articles are in their regular positions.

The second sensors are as many as all the articles in the article row except the ones at the opposite ends of the article row. These second sensors are arranged at predetermined intervals longer than the width of each article in a direction perpendicular to the transportation path for article rows. The second sensors detect their corresponding articles in the article row and output detection signals when the article row is in the inspecting position.

According to the detecting device described above, at least one of the sensors, first or second, outputs no detection signal if the articles in the article row are insufficient. Thus, shortage of the articles in the article row can be detected in accordance with the detection signals from the first and second sensors.

More specifically, a detecting sensitivity zone of each second sensor is set in accordance with the number of articles in the article row and the detecting sensitivity distance of the first sensors. In other words, the second sensors are arranged depending on the detecting sensitivity distance of the first sensors, the detecting sensitivity zones of the second sensors, and the number of articles in the article row. The larger the number of articles in the article row, in this case, the narrower the detecting sensitivity zones of the second sensors are. Thus, shortage of the articles can be accurately detected without regard to the number of articles in the article row.

The article row may be packaged in a packaging medium when it reaches the inspecting position. In this case, non-contact sensors or proximity sensors are used as the first and second sensors. In the case where the articles are cigarette packs, for example, the proximity sensor can detect aluminum foil in which cigarettes in the subject cigarette pack are wrapped.

Preferably, moreover, the article row is temporarily stopped at the inspecting position on the transportation path. In this case, the detecting device can easily specify the time for an inspection of the articles.

Further scopes of applicability of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
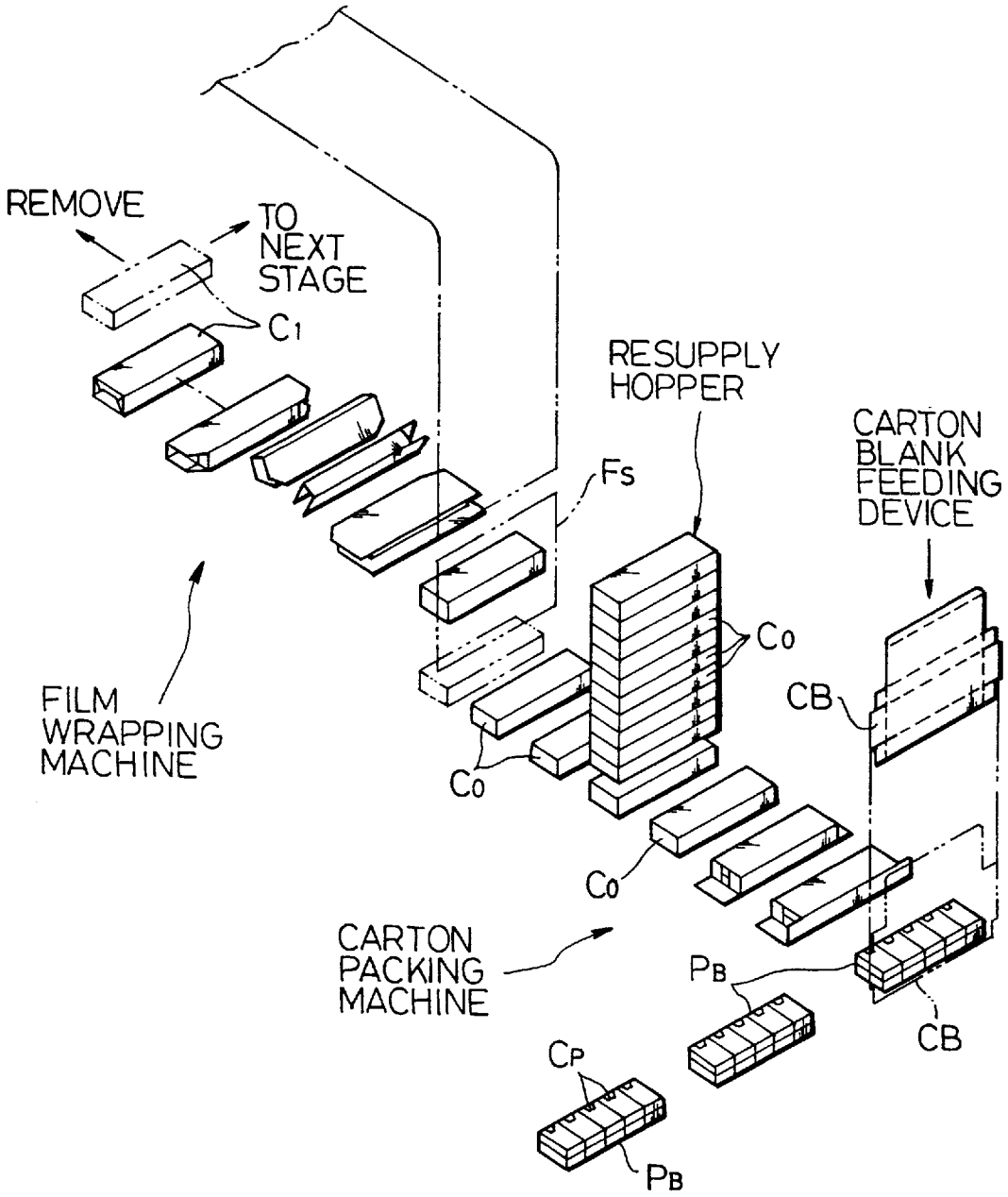
FIG. 1 is a schematic view showing the way pack blocks are transported in a carton packing machine and a film wrapping machine.

Referring to FIG. 1, there is schematically shown a carton packing machine for packaging a plurality of cigarette packs in each carton. This packaging machine is also applicable to the case of packaging cigarette packs in each parcel.

The carton packing machine is provided with a path of transportation for pack blocks $P_B$. Each pack block $P_B$ is formed of two rows of cigarette packs $C_p$ stacked in layers, upper and lower, each row including five packs. As each pack block $P_B$ is transported along the transportation path, it is wrapped in a carton blank CB, whereupon a carton $C_0$ is obtained. Carton blanks CB are fed from a feeding device (not shown) to their transportation path. Thereafter, each carton $C_0$ is transported along its transportation path toward a film wrapping machine. In this wrapping machine, the carton $C_0$ is reversed as it is wrapped in a film sheet FS, whereupon a finished carton $C_1$ is obtained.

In the carton packing machine and the film wrapping machine, respectively, the cartons $C_0$ and the finished cartons $C_1$ are inspected, whereby shortage of the cigarette packs $C_p$ in each carton $C_0$ and each finished carton $C_1$ is detected, that is, it is determined whether or not there are a predetermined number of cigarette packs $C_p$ in each carton. Based on the result of this detection, those cartons $C_0$ or finished cartons $C_1$ which are short on the number of cigarette packs are removed from the transportation path, and only nondefective finished cartons $C_1$ are transported to be delivered to the next stage.

Figure 2:
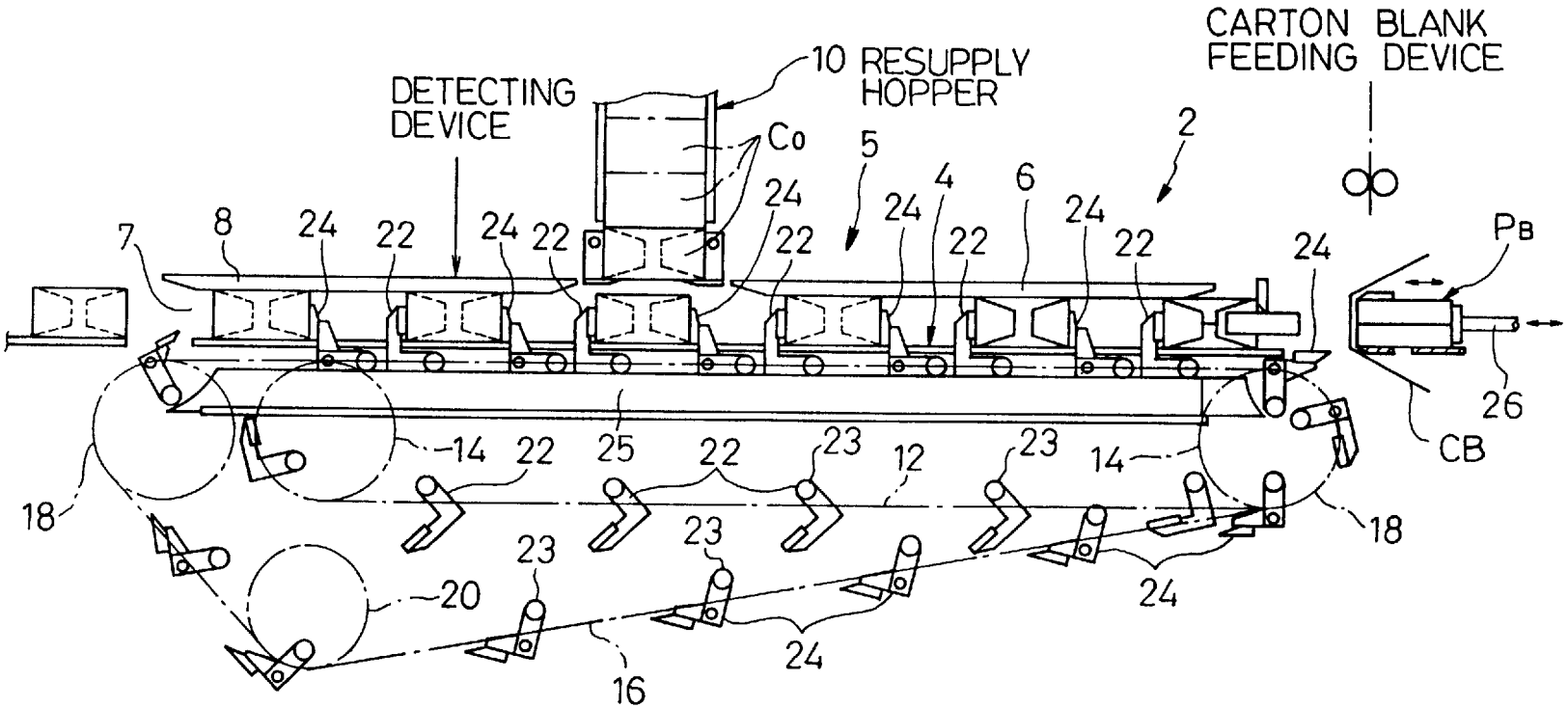
FIG. 2 is a schematic side view showing the carton packing machine.

Referring to FIG. 2, there is shown a specific carton packing machine 2. This machine 2 is provided with a lower transportation guide 4, which constitutes part of the aforesaid transportation path. The lower transportation guide 4 extends horizontally from under the carton blank feeding device. As shown in FIG. 1, the transportation path for the pack blocks $P_B$ is bent at 90°.

An upper transportation guide 5 overlies the lower transportation guide 4, the two guides extending parallel to each other. The lower and upper transportation guides 4 and 5 define a transportation passage 7 for the pack blocks $P_B$. More specifically, the upper transportation guide 5 includes an upstream-side portion 6 and a downstream-side portion 8 between which a predetermined space is secured. A resupply hopper 10 is located between the upper transportation guides 6 and 8, and its outlet is situated right over the space between the guides 6 and 8. Previously formed cartons C are stacked in layers in the hopper 10.

The lower transportation guide 4 is underlain by a pair of toothed belts or endless timing belts 12, right and left as viewed in the direction of transportation of the pack blocks $P_B$. Each timing belt 12 is passed around and between a pair of toothed pulleys 14 that are spaced in the transportation direction of the pack blocks $P_B$. The pulleys 14 are arranged individually under the opposite end portions of the lower transportation guide 4. The upper portion of each belt 12 extends directly under the lower transportation guide 4 in parallel relation.

The lower transportation guide 4 is further underlain by a pair of timing belts 16, right and left. These timing belts 16 are located individually on the opposite sides of the timing belts 12 as viewed in the transportation direction of the pack blocks $P_B$. Each timing belt 16 is passed around and between a pair of toothed pulleys 18. The upper portion of each belt 16 extends within the same plane as that of each timing belt 12. As seen from FIG. 2, those toothed pulleys 14 and 18 which are situated on the starting end side of the lower transportation guide 4 are mounted on one and the same driving shaft, while those toothed pulleys 14 and 18 which are situated on the terminal end side of the guide 4 are mounted on two independent driven shafts, individually. The respective lower portions of the timing belts 16 are guided individually through guide pulleys 20. The pulleys 20 keep the lower portions of the belts 16 wide apart from those of the timing belts 12.

Each timing belt 12 has a large number of front claws 22, which are arranged at predetermined intervals. More specifically, each front claw 22 is mounted on a shaft, the opposite ends of which is connected individually to the right and left timing belts 12. Further, each claw 22 is urged to rotate in one direction around the shaft. Each timing belt 16 has a large number of rear claws 24, which are attached to each belt 16 in the same manner as the front claws 22.

The timing belts 12 and 16 are run intermittently in synchronism with one another. Thus, the front and rear claws 22 and 24 successively get into the transportation passage 7 through an upstream-side inlet of the passage 7. In the transportation passage 7, the front and rear claws 22 and 24 are kept upright and opposite to one another by the agency of a cam mechanism, and constitute a bucket for the pack blocks $P_B$. The cam mechanism includes roller-type cam followers 23, which are attached individually to the front and rear claws 22 and 24, and a cam plate 25 that cooperates with the clam followers.

FIG. 2 shows a state immediately after one of the front claws 22 gets into the transportation passage 7 through the inlet thereof. In this state, the front claw 22 is kept upright, and that rear claw 24 which is paired with this claw 22 is situated in the vicinity of the inlet of the transportation passage 7 without getting into the passage 7. More specifically, that rear claw 24 is situated between the inlet of the passage 7 and that portion of the transportation path which is located on the upstream side of the lower transportation guide 4, and forms an extension of the lower transportation guide 4.

In this state, a pack block $P_B$, along with a carton blank CB, is pushed in toward the inlet of the transportation passage 7 from the upstream-side portion thereof by a pusher 26. As this is done, the front face of the pack block $P_B$ abuts against the carton blank CB, and bends it into the shape of a U along the upper and lower surfaces of the block $P_B$. Thereafter, one inner side flap of the carton blank CB is turned in along the opposite side faces of the pack block $P_B$, while an upper body flap of the blank CB is bent along the rear side face of the block $P_B$.

When the timing belts 12 and 16 are then caused to travel for a predetermined distance, a rear claw 24 having been situated in the vicinity of the inlet of the transportation passage 7 rises, and turns in a lower body flap of the carton blank CB, whereupon the lower body flap is put on the upper body flap and the lower and upper body flaps are adhered each other. At this point of time, the pack block $P_B$ is held between the front and rear claws 22 and 24, which form a bucket. Thereafter, the other inner side flap of the carton blank CB is turned in. In this state, paste is applied to the inner side flaps of the blank CB.

When the bucket, along with the pack block $P_B$, is then transported to the next position as the timing belts 12 and 16 travel, right and left outer side flaps of the carton blank CB are turned in and bonded individually to the inner side flaps, whereupon packaging the pack block $P_B$, that is, carton packing, is completed, and a carton $C_0$ is obtained.

When the pack blocks $P_B$ are successively fed into the transportation passage 7 in the aforesaid manner, they are packaged individually as cartons $C_0$.

As the cartons $C_0$, along with the buckets, are transported intermittently in the transportation passage 7, the buckets are successively situated right under the resupply hopper 10. When the buckets are empty, the cartons $C_0$ are fed from the hopper 10 into the buckets.

Figure 3:
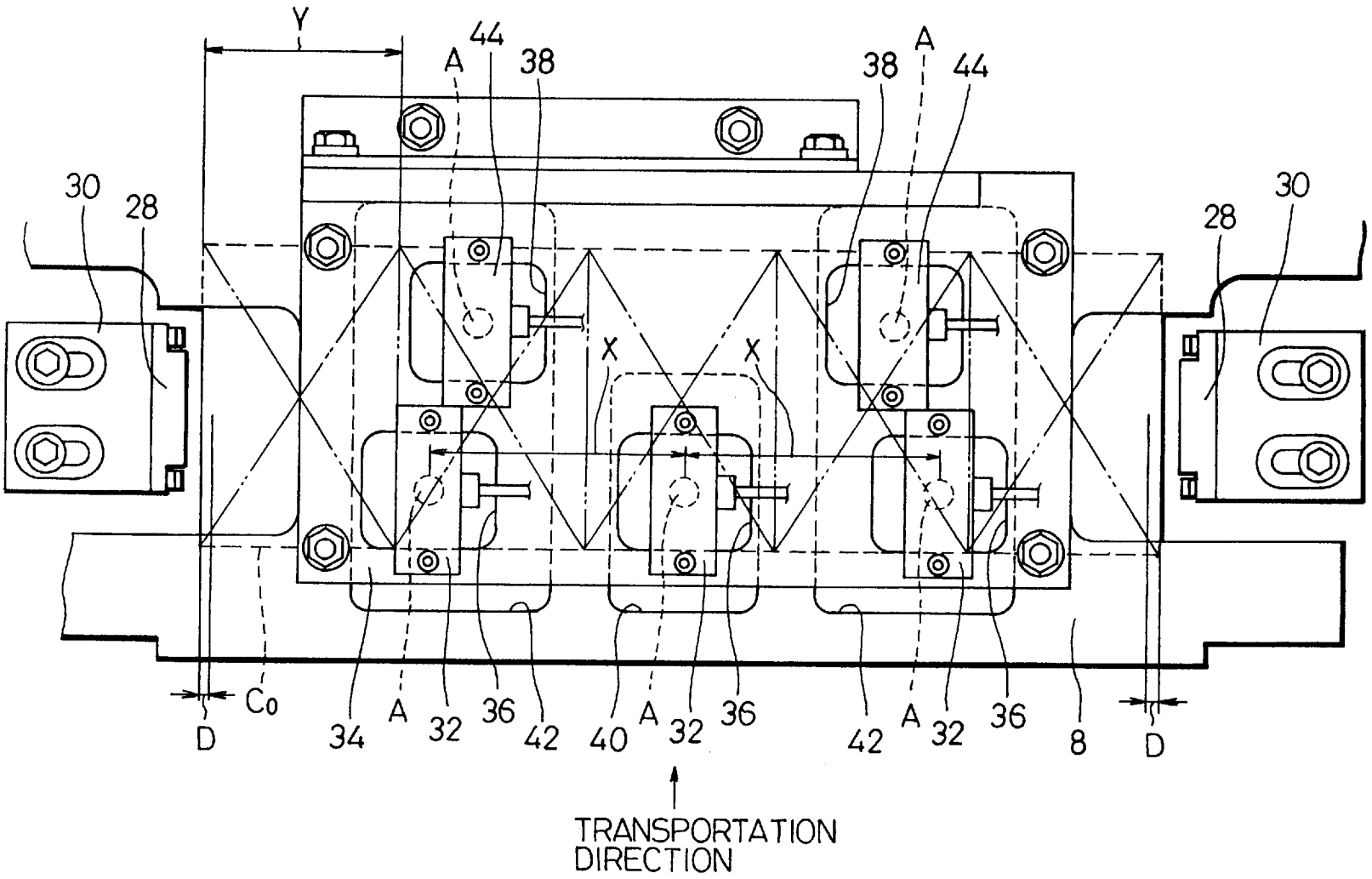
FIG. 3 is a plan view of a detecting device incorporated in the carton packing machine.

After passing together with the buckets through the resupply hopper 10, the cartons $C_0$ are subjected to an inspection in the next stop position or inspecting position by means of a detecting device. FIG. 3 is a detailed view of the detecting device.

The detecting device comprises a pair of first proximity sensors 28, which are arranged on the opposite sides of the transportation passage 7, individually. Thus, the sensors 28 face each other with the passage 7 between them. A capacitance-type displacement sensor is used as each first proximity sensor 28, which can detect an aluminum foil for use as an inner wrapper for each cigarette pack. A distance D from each end face of the carton $C_0$ in the inspecting position to inside of the carton $C_0$ represents the detecting sensitivity of the sensor 28. More specifically, when the cigarette packs $C_p$ situated individually at the opposite ends of one pack row in the carton $C_0$ are in their regular positions without dislocation, the pair of first proximity sensors 28 detect the cigarette packs $C_p$ at the opposite ends or their aluminum foils, and output on-signals as the results of the detection, individually. In the case where the cigarette packs $C_p$ at the opposite ends are off the regular positions, on the other hand, the first proximity sensors 28 output off-signals. In FIG. 3, only the contour of the carton $C_0$ is represented by broken line.

In order to adjust the aforesaid distance D, each first proximity sensor 28 is mounted on a movable base 30, which can move in a direction perpendicular to the transportation passage 7. As seen from FIG. 4, the pair of proximity sensors 28 are located on the same level as the upper pack row in the carton $C_0$. Accordingly, the sensors 28 detect those cigarette packs $C_p$ which are situated individually at the opposite ends of the upper pack row.

The detecting device further comprises three second proximity sensors 32, which are arranged over the transportation passage 7. More specifically, a platelike mounting base 34 is fixed to the upper surface of the upper transportation guide 8. The base 34 has three first upper apertures 36 and two second upper apertures 38. The first upper apertures 36 are arranged in a direction crossing the transportation passage 7. The second upper apertures 38 are arranged on the downstream side of the two opposite-side upper apertures 36, as viewed in the transportation direction of the carton $C_0$. The apertures 38 are situated a little nearer to the center of the passage 7 than the apertures 36 on either side.

On the other hand, the upper transportation guide 8 is formed with three lower apertures 40 and 42. The central first upper aperture 36 faces to the transportation passage 7 through the lower aperture 42 in the center, while the opposite-side first upper apertures 36 and the second upper apertures 38 face the passage 7 through the lower apertures 42 on either side.

The second proximity sensors 32 are arranged individually in the first upper apertures 36 of the mounting base 34 so as to face the interior of the transportation passage 7. More specifically, each second sensor 32 has its distal end projecting into its corresponding lower aperture 40 or 42, and is supported on the mounting base 34 by means of a holder plate. The intervals between the second proximity sensors 32 are equal.

Further, third proximity sensors 44 are arranged individually in the second upper apertures 38 of the mounting base 34 so as to face the interior of the transportation passage 7. These third sensors 44 are fixed to the mounting base 34 in the same manner as the second With respect to the carton $C_0$ in the inspecting position, as seen from FIG. 3, the second proximity sensors 32 are situated individually over the three inner cigarette packs $C_p$ in the upper pack row, not the two packs $C_p$ at the opposite ends of the row. In FIG. 3, the individual cigarette packs $C_p$ in the pack row are indicated by two-dot chain lines. On the other hand, the third proximity sensors 44 are situated individually over those two cigarette packs $C_p$ which are situated next to the ones at the opposite ends of the pack row.

Figure 4:
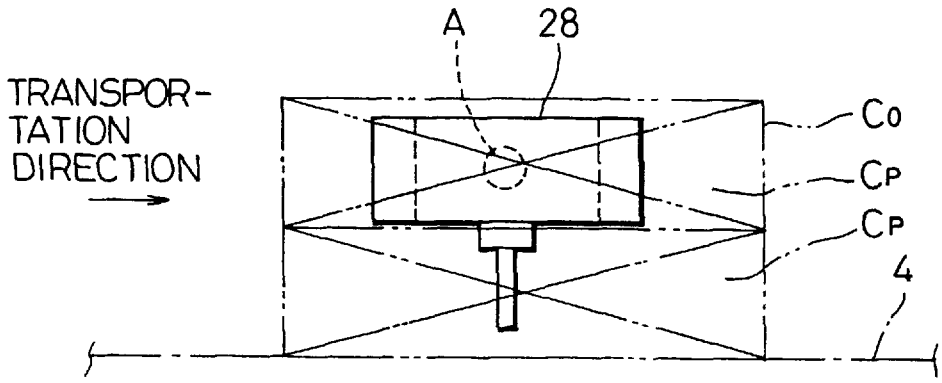
FIG. 4 is a view showing the height of location of a first proximity sensor.

In FIGS. 3 and 4, the respective detecting sensitivity zones of the first, second, and third proximity sensors 28, 32 and 44 are represented individually by broken-line circles A. These sensitivity zones are adjustable.

The second and third proximity sensors 32 and 44, like the first proximity sensors 28, can be formed of capacitance-type displacement sensors. Thus, the second third sensors 32 and 44 individually output on-signals when they detect the respective aluminum foils of their corresponding cigarette packs $C_p$ in the carton $C_0$ in the inspecting position. The respective detecting sensitivities of the second and third sensors 32 and 44 are equal to that of the first proximity sensors 28.

As is evident from the above description, the three second proximity sensors 32 are arranged at regular intervals (X) in the direction crossing the transportation passage 7. The distance (Z) between the end face of the carton $C_0$ and its nearest second proximity sensor 32 is longer than the width (Y) of each cigarette pack $C_p$ and shorter than 3Y/2.

Figure 5:
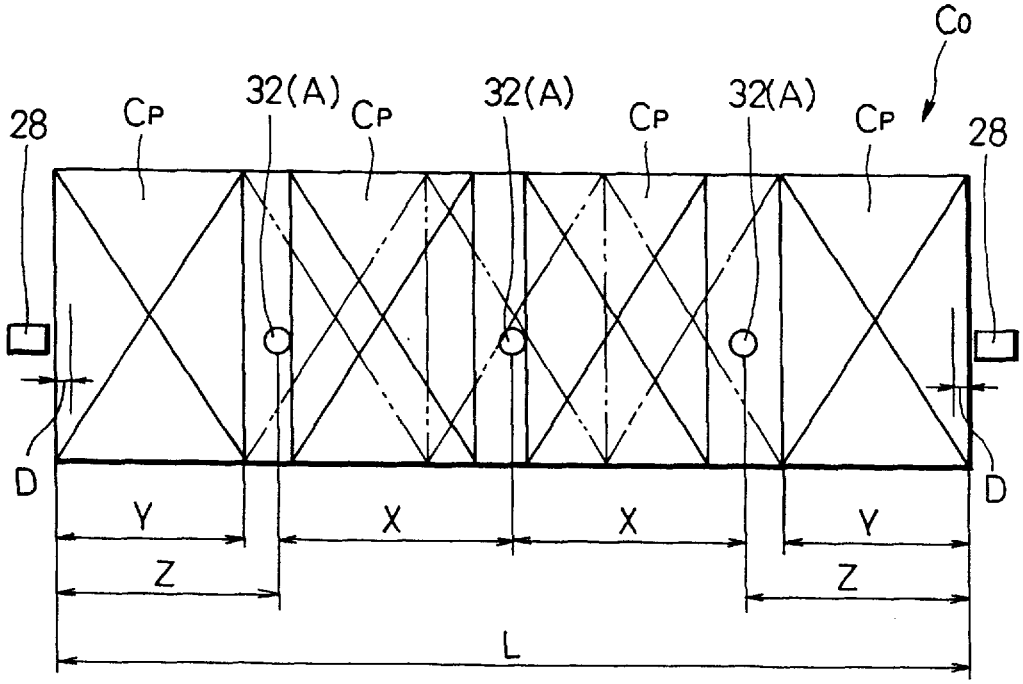
FIG. 5 is a view for illustrating functions of first and second proximity sensors applied to a carton that contains ten cigarette packs.

Referring to FIG. 5, there are more definitely shown the relationships between the interval X, distance Z, and width Y. In FIG. 5, the second proximity sensors 32 are represented by their respective detecting sensitivity zones only.

More specifically, in connection with the arrangement of the second proximity sensors 32, the interval X and the distance Z are obtained according to the following equations, and are longer than the width Y:

$$Z=Y+[\{L-N_s\times A_D-(N_p-1)\times Y-2\times D\}/(N_p-1)]+A_D/2,$$

$$X=(L-2\times Z)/(N_s-1),$$

where we have $N_s=N_p-2$, L is the overall length of each cigarette pack $C_p$, $N_s$ is the number of second proximity sensors 32, $A_D$ is the diameter of the detecting sensitivity zone of each second sensor 32, $N_p$ is the number of cigarette packs $C_p$ in each pack row in each carton, and D is the distance for the detecting sensitivity of each first proximity sensor 28.

In the case of a ten-pack carton $C_0$ containing cigarette packs $C_p$ with the width Y of 56 mm, its overall length L is 284 mm. If $A_D$=8 mm and D=2 mm are given in this case, we obtain Z=70 mm and X=72 mm. The overall length of the carton $C_0$ includes the thickness of the carton blank CB.

The first, second, and third proximity sensors 28, 32 and 44 are connected electrically to a controller (not shown). The controller can detect shortage of the cigarette packs $C_p$ in the carton $C_0$ in accordance with output signals from the sensors 28, 32 and 44.

More specifically, when the carton $C_0$ is situated in the inspecting position as it is transported intermittently, the controller fetches the output signals from the first to third proximity sensors 28, 32 and 44. Based on these output signals, the controller determines whether or not the upper pack row in the carton $C_0$ includes a predetermined number of cigarette packs $C_p$, that is, whether or not there is no shortage of the cigarette packs $C_p$ in the pack row. If the upper pack row in the carton $C_0$ includes five cigarette packs $C_p$, for example, all the outputs of the first to third proximity sensors 28, 32 and 44 are on-signals. In this case, the controller concludes that the upper pack row is regular.

If the upper pack row is one cigarette pack short, the output of at least one of the first and second proximity sensors 28 and 32 is an off-signal. In response to this off-signal, the controller concludes that the cigarette packs $C_p$ are insufficient in number. The off-signal from the proximity sensor can be obtained in accordance with the aforesaid arrangement of the first and second proximity sensors 28 and 32 and the detecting sensitivity distances and zones of these sensors.

Let it now be supposed that the pack row is one cigarette pack short and that the two inner cigarette packs $C_p$ are off their regular positions although the packs $C_p$ at the opposite ends of the pack row are situated in their respective regular positions, as shown in FIG. 5. In this case, the respective outputs of the first proximity sensors 28 are on-signals, and those of two of the second proximity sensors 32 are also on-signals. However, the output of the remaining one of the second sensors 32 is an off-signal. Thus, although the two central cigarette packs $C_p$ in the pack row are situated in positions such that they can narrowly be detected by means of their corresponding second sensors 32, as seen from FIG. 5, the remaining second sensor 32 cannot detect any cigarette pack $C_p$. Accordingly, there is no possibility of any cigarette pack $C_p$ getting into the detecting sensitivity zone of the remaining second sensor 32.

Figure 6:
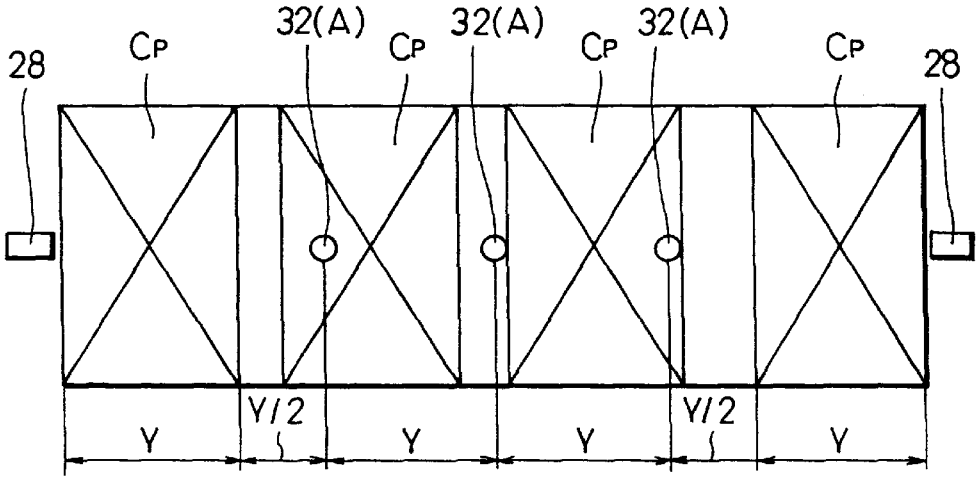
FIG. 6 is a view showing a layout of first and second proximity sensors different from the ones according to the embodiment.

In the conventional detecting device, as shown in FIG. 6, three second proximity sensors 32 are arranged at intervals that are equal to the width Y of each cigarette pack $C_p$ each, and each second sensor 32 is located so as to detect the center of each corresponding cigarette pack $C_p$ in its regular position with respect to the width direction. Even though the pack row is one cigarette pack short, in this case, all of four cigarette packs $C_p$ can be detected by means of the first and second proximity sensors 28 and 32 if they are situated individually in the positions shown in FIG. 6, and all the outputs of these proximity sensors are on-signals. In this situation, therefore, the controller cannot detect the shortage of the cigarette packs $C_p$.

The shortage of the cigarette packs $C_p$ is determined in the aforementioned manner by means of the controller with the carton $C_0$ situated in the inspecting position and temporarily stopped from being transported. When bucket transportation is suspended, as shown in FIG. 7, the controller fetches the output signals from the first and second proximity sensors 28 and 32, and gives a decision on the shortage of the cigarette packs $C_p$ in the carton $C_0$ in accordance with these output signals.

Figure 7:
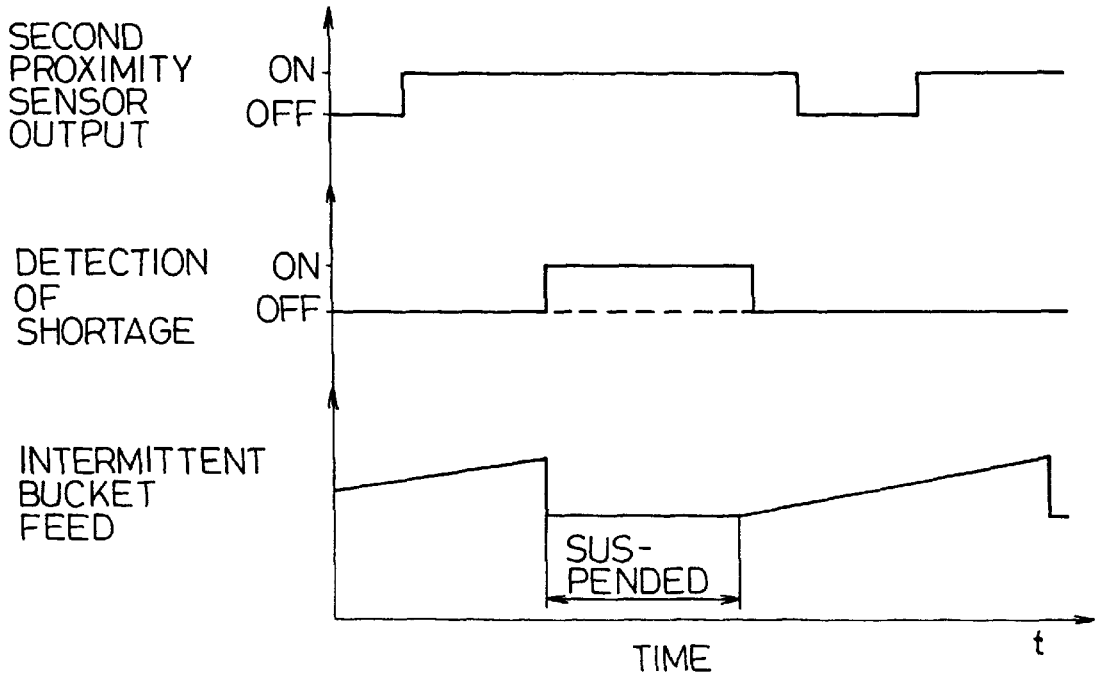
FIG. 7 is a graph showing changes of outputs from the second proximity sensors associated with transportation of a carton.
Figure 8:
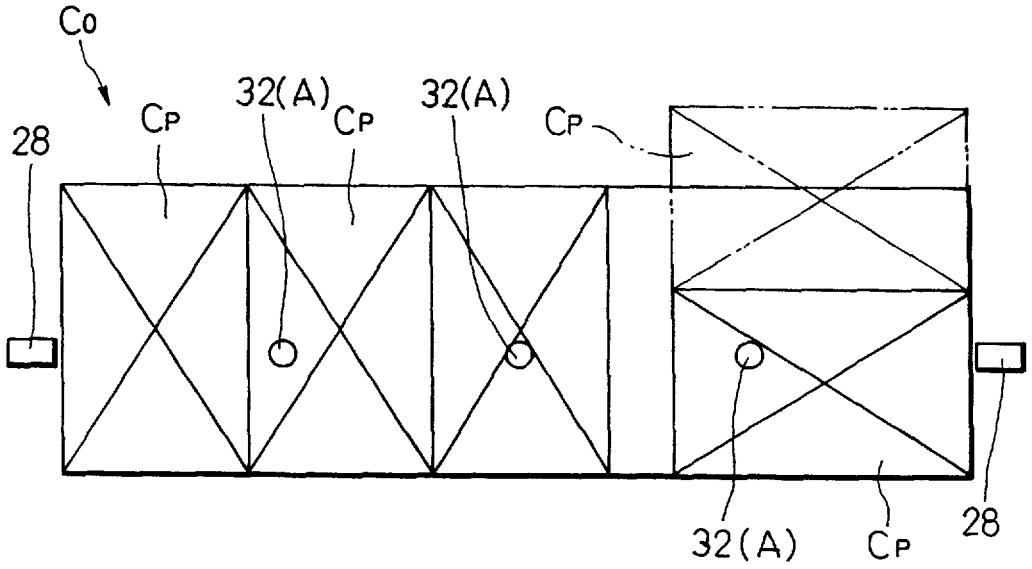
FIG. 8 is a view for illustrating other functions of the second proximity sensors.

As seen from FIG. 7, the proximity sensors 28 and 32 output on-signals the moment the cigarette packs $C_p$ in the carton $C_0$ start to get into detecting sensitivity zones A of the sensors during the transportation of the carton $C_0$. The on-signals continue to be outputted until the carton $C_0$ gets out of the sensitivity zones A of the proximity sensors. Thus, the period during which the respective outputs of the first and second proximity sensors 28 and 32 are on-signals can be determined depending on the intermittent transportation of the carton $C_0$. As shown in FIG. 8, therefore, if the outputs of the proximity sensors 28 and 32 are off-signals during the period in which they are expected to be on-signals, or if they are on during the period in which they are expected to be off, the controller can conclude that the cigarette packs $C_p$ in the carton $C_0$ are disturbed. Such disturbance is attributable to shortage of the cigarette packs $C_p$. The situation represented by two-dot chain line in FIG. 8 indicates that the carton $C_0$ is not stuffed satisfactorily with the cigarette packs.

Further, the detecting device is provided with the third proximity sensors 44 as well as the first and second proximity sensors 28 and 32. In the case where the carton is stuffed with cigarette packs having different widths Y, therefore, the third sensors 44 can be used in place of the two second sensors 32, right and left and the shortage of the cigarette packs in the carton is detected in the similar manner.

A detecting device similar to the aforementioned detecting device can be also incorporated into the film wrapping machine. The detecting device in the wrapping machine is used to detect a lower pack row in the carton $C_0$. Thus, the detecting device in the carton packing machine and the film wrapping machine can detect the upper and lower pack rows in the carton $C_0$, individually.

Figure 9:
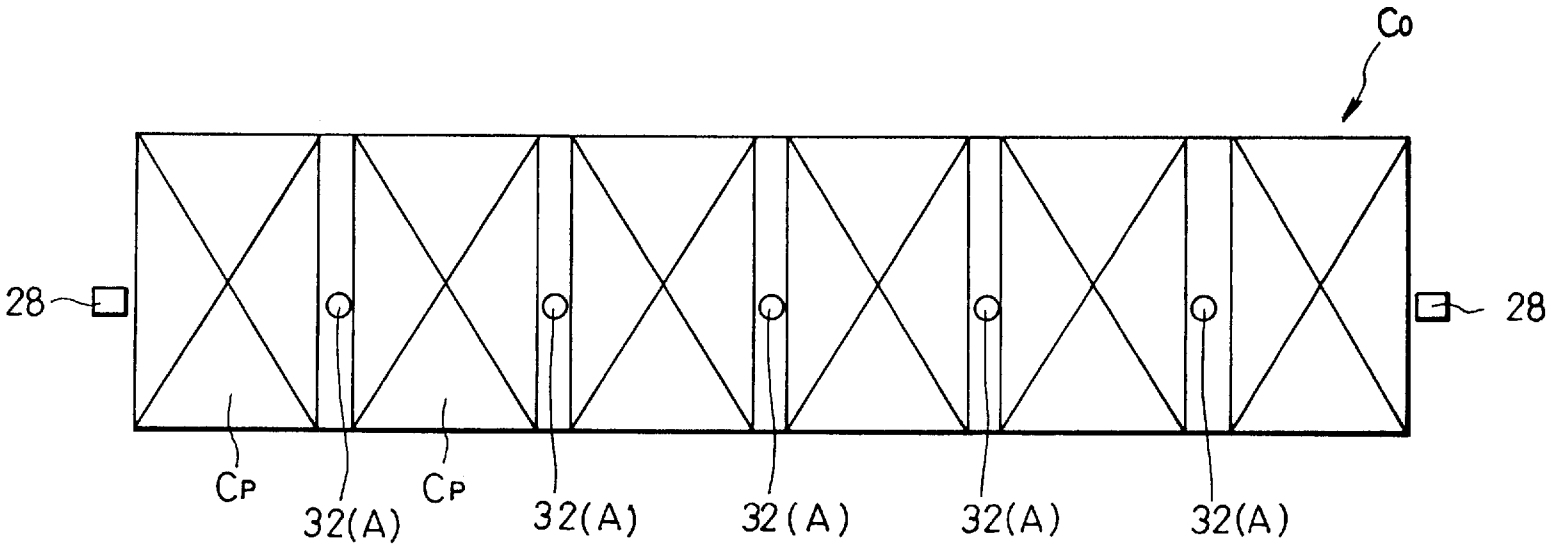
FIG. 9 is a view for illustrating functions of the first and second proximity sensors applied to a carton that contains 14 cigarette packs.
Figure 10:
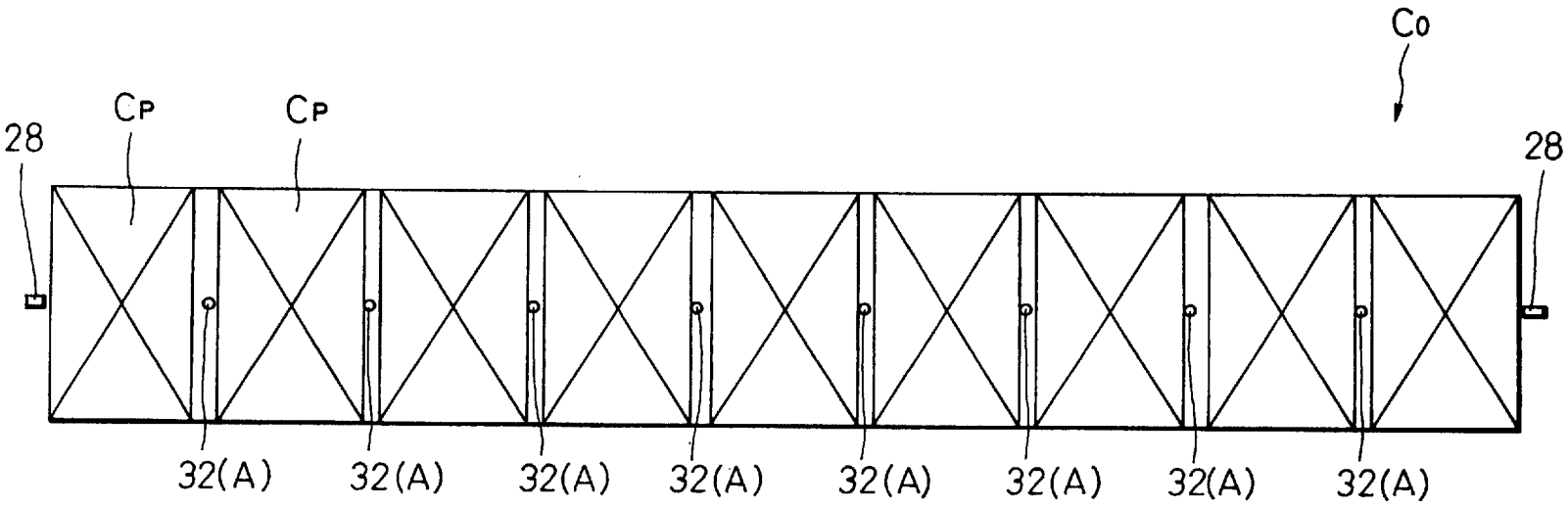
FIG. 10 is a view for illustrating functions of the first and second proximity sensors applied to a carton that contains 20 cigarette packs.

Although the detecting devices according to the embodiment described above are applied to the cartons $C_0$ that contain ten cigarette packs each, detecting devices of the present invention are applicable to any cartons that contain eight or more cartons each. FIGS. 9 and 10 show examples that are applied to cartons $C_0$ containing 14 and 20 cigarette packs each, respectively. In FIGS. 9 and 10, each carton $C_0$ is one cigarette pack short.

In the case of the 14-pack carton $C_0$, as shown in FIG. 9, if L=396 mm, $A_D$=8 mm, D=2 mm, and Y=56 mm are given, the interval X and the distance Z are adjusted to X=66.67 mm and Z=64.67 mm, respectively.

In the case of the 20-pack carton $C_0$, as shown in FIG. 10, if L=564 mm, $A_D$=4 mm, D=2 mm, and Y=56 mm are given, the interval X and the distance Z are adjusted to X=62.67 mm and Z=62.67 mm, respectively.

According to the embodiment described herein, the detecting devices are used to detect shortage of the cigarette packs in each carton. However, the detecting devices of the present invention are also applicable to parcels that each include ten cigarette packs wrapped in wrapping paper. The parcels can be obtained by supplying the wrapping paper in place of film to the film wrapping machine shown in FIG. 1. In this case, the pack blocks $P_B$ are simply intermittently transported along the transportation passage 7 of the carton packing machine, and an upper pack row in each pack block $P_B$ is inspected in the packing machine.

Further, the detecting devices of the present invention are applicable to any other packages than cigarette packs that are stuffed with various articles.

What is claimed is:

1. A device for detecting shortage of articles in an article row to be packaged, the article row including a plurality of articles arranged in regular order and being transported sideways on a transportation path so as to pass an inspecting position defined on the transportation path, said device comprising:

a pair of first sensors arranged on either side of the transportation path and adapted individually to detect the articles situated at the opposite ends of the article row, said first sensors outputting detection signals when the articles are in regular positions thereof as the article row passes the inspecting position; and a plurality of second sensors arranged at predetermined intervals in a direction perpendicular to the transportation path, each said interval being longer than the width of each the article as viewed in the direction perpendicular to the transportation path, said second sensors being adapted individually to detect other articles than the ones at the opposite ends of the article row and outputting detection signals when the article row passes the inspecting position.

2. The device according to claim 1, wherein each said second sensors has a detecting sensitivity zone set in accordance with the number of articles in the article row and a detecting sensitivity distance of said first sensors.

3. The device according to claim 1, wherein said second sensors are arranged depending on a detecting sensitivity distance of said first sensors, a detecting sensitivity zones of said second sensors, and the number of articles in the article row.

4. The device according to claim 1, wherein said article row is packaged in a packaging medium when in the inspecting position.

5. The device according to claim 4, wherein said first and second sensors are non-contact sensors.

6. The device according to claim 5, wherein said first and second sensors are proximity sensors for detecting a component of the article.

7. The device according to claim 6, wherein each said article is a cigarette pack, and the component is an aluminum foil wrapping cigarettes in the cigarette pack therein.

8. The device according to claim 7, wherein said article row is intermittently transported on the transportation path and temporarily stopped at the inspecting position.

9. The device according to claim 1, wherein said first and second sensors keep outputting the detecting signals during the detection of the corresponding article in the article row.

* * * * *